United States Patent [19]

Mercer

[11] Patent Number: 4,540,447

[45] Date of Patent: Sep. 10, 1985

[54] METHOD OF MAKING A MULTIGRIP FASTENER AND FASTENER MADE THEREBY

[75] Inventor: Larry D. Mercer, Hewitt, Tex.

[73] Assignee: Huck Manufacturing Company, Irvine, Calif.

[21] Appl. No.: 502,740

[22] Filed: Jun. 9, 1983

[51] Int. Cl.[3] ..... C21D 8/00

[52] U.S. Cl. ..... 148/2; 148/12 B; 148/36; 148/39; 411/361

[58] Field of Search ..... 411/43, 70, 361; 148/12 R, 36, 12.1, 35, 12 B, 12 F, 2, 3, 115 R

[56] References Cited

U.S. PATENT DOCUMENTS

| | | | |
|---|---|---|---|
| 3,532,560 | 10/1970 | Tomioka et al. | 148/12 B |
| 3,701,694 | 10/1972 | Osuka | 148/12 |
| 4,049,473 | 9/1977 | Davis, II et al. | 148/16.5 |
| 4,202,710 | 5/1980 | Naito et al. | 148/16.5 |
| 4,208,943 | 6/1980 | Smith | 411/361 |
| 4,386,972 | 6/1983 | Knight | 148/16 |

OTHER PUBLICATIONS

"Making Shaping and Treating of Steel", 9th Edition, pp. 1087, 1096–1097, ©1971.

*Primary Examiner*—L. Dewayne Rutledge
*Assistant Examiner*—Christopher W. Brody
*Attorney, Agent, or Firm*—Harness, Dickey & Pierce

[57] ABSTRACT

This disclosure relates to swage type fasteners including a pin having a plurality of combination locking and breakneck grooves and a collar adapted to be swaged into the grooves with one of the grooves acting as a breakneck whereby the excess length of pin is severed generally at the end of the collar and also relates to a method of making the pin. The multigrip pin is formed generally into its final shape and then is subject to a heat treating process to provide a desirable microstructure whereby more consistent breaks at the selected groove occurs. In one form of the invention a desirable microstructure consists of predominantly pearlite colonies with a proeutectoid ferrite matrix interspersed at the boundaries of pearlite colonies.

16 Claims, 4 Drawing Figures

METHOD OF MAKING A MULTIGRIP FASTENER AND FASTENER MADE THEREBY

BACKGROUND AND SUMMARY OF THE INVENTION

The present invention relates to swage type fasteners including a pin having a plurality of combination locking and breakneck grooves and a collar adapted to be swaged into the grooves with one of the grooves acting as a breakneck whereby the excess length of pin is severed generally at the end of the collar and also relates to a method of making the pin.

The present invention relates to multigrip fasteners of the type shown in U.S. Pat. Nos. 4,208,943 and 4,342,529 and the disclosures of those patents are incorporated herein by reference.

As seen from the noted patents, fasteners of the multigrip type include a pin having combination locking and breakneck grooves and a collar adapted to be swaged into these grooves. The contour of the grooves are such that any one of the grooves when located at the end of the collar can function as a breakneck. It has been found, however, that with pins made of ferrous materials inconsistent breaks can occur caused by variations in the material and/or its processing. Thus if the material is too brittle breaks may occur several grooves outside of the collar or the collar may not completely swage before the pin fractures. On the other hand, the material as processed may have a microstructure permitting excessive stretching before fracture resulting in breaks within the collar and/or breaks across more than one groove.

In the present invention, the multigrip pin is formed generally into its final shape and then is subject to a heat treating process to provide a desirable microstructure whereby more consistent breaks at the selected groove occurs.

In one form of the invention a desirable microstructure consists of predominantly pearlite colonies with a proeutectoid ferrite matrix interspersed at the boundaries of pearlite colonies. The amount and thickness of the proeutectoid ferrite can be controlled to produce the desired ductility of the pin. It has been found that the lesser amount of proeutectoid ferrite inherent in coarse grained steel is more advantageous to the function of the pin. The size of the pearlite colonies (or the apparent austenitic grain size) is generally coarser than ASTM 5 and generally within a range of from about ASTM 1 to about ASTM 5.

Therefore it is an object of the present invention to provide a process for making a multigrip pin having a microstructure which enhances the consistency of fracture at the desired one of the combination locking and breakneck grooves.

It is a further object of the present invention to provide a process for making a multigrip pin of a ferrous material having a microstructure comprised predominantly of coarse grained pearlite colonies with controlled amounts of proeutectoid ferrite interspersed at the pearlite colony grain boundaries.

It is another object of the present invention to provide a multigrip pin manufactured by the process of the present invention.

It is still another object of the present invention to provide a multigrip pin having a grain structure comprised predominantly of coarse grained pearlite colonies and controlled amounts of proeutectoid ferrite interspersed at the pearlite colony grain boundaries as manufactured by the process of the present invention.

Other objects, features, and advantages of the present invention will become apparent from the subsequent description and the appended claims, taken in conjunction with the accompanying drawings in which:

DESCRIPTION OF THE PREFERRED EMBODIMENTS

Figure 1:
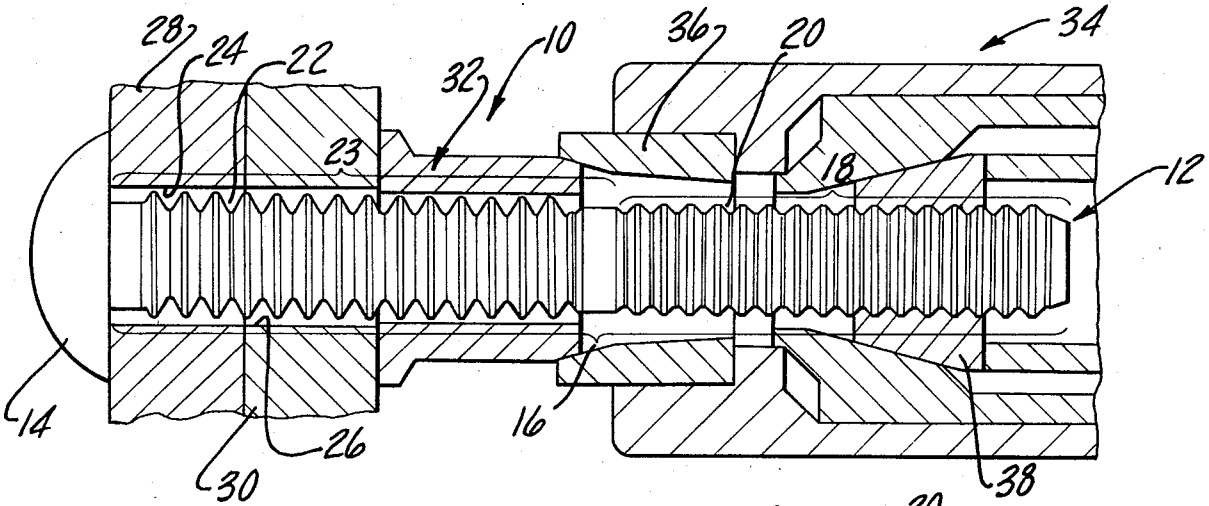
FIG. 1 is a partially sectioned view of a multigrip fastener, including a pin and collar, shown in assembly relationship with a pair of workpieces and in operative engagement with an installation tool.

Referring now to FIG. 1 of the drawings a multigrip fastener 10 is shown and includes a pin member 12 having a head 14 on one end thereof and an elongated shank portion 16. The pin member 12 has an outer end portion 18 having a plurality of pull grooves 20 and an inner portion 23 having combination locking and breakneck grooves 22. The pull grooves 20 can be of a conventional construction; both the combination grooves 22 and pull grooves 20 can be of the type shown and described in the noted U.S. Pat. No. 4,342,529 and hence the details thereof will be omitted for purposes of simplicity.

The multigrip pin or pin member 12 is designed to be inserted in aligned openings 24 and 26 provided in a pair of workpieces 28 and 30, respectively, which are to be joined by the fastener 10. A tubular member 32 in the form of a generally cylindrically shaped, flanged collar is placed over the shank portion 16 with the flange against the workpiece 30.

Figure 2:
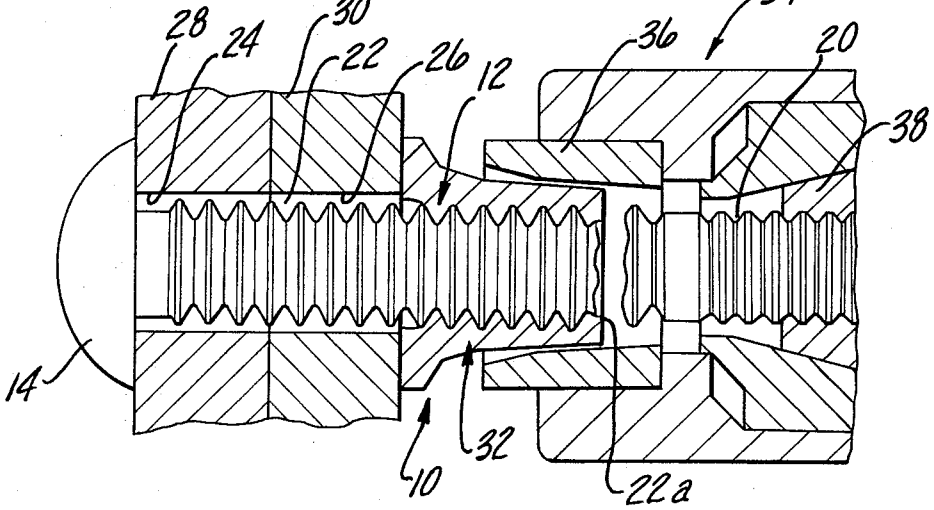
FIG. 2 is a view similar to FIG. 1 depicting the multigrip fastener after it has been set by the installation tool.

An installation or pulling tool 34 is of a conventional construction having a swaging anvil 36. A plurality of gripping jaws 38 are engageable with the pull grooves 20 and are adapted to be moved rearwardly relative to the swaging anvil 36. Actuation of the tool 34 will cause jaws 38 to move away from anvil 36 and to engage and grip the pull grooves 20 to thereby exert a pulling or tensioning force upon the pin 12 and against the collar 32. Initially this clamps the workpieces 28 and 30 together. As the tool 34 continues the pulling action, the anvil 36 swages the collar 32 into the combination grooves 22 (see FIG. 2). Further actuation of the tool 34 results in fracture at groove **22*a*** which is desirably the outermost groove which is first filled with collar material.

As noted, it appears that, with multigrip pins 12 made of ferrous materials, the microstructure can be a significant factor affecting the consistency of fractures occurring at the desired one of the combination grooves 22. Thus with a microstructure comprised mainly of pearlite (actually pearlite colonies) with little or no proeutectoid ferrite matrix the pin 12 will have a characteristic which will provide inconsistent fractures and/or partial swaging of the collar 32. On the other hand a microstructure that includes too much of the ferrite matrix will have excessive ductility which will result in excessive necking within the collar 32 and which will promote fractures within the collar 32 and/or across more than one groove. It should be noted that the ferrite at the boundaries of the pearlite colonies is a proeutectoid ferrite matrix (or network); this is in contrast with the ferrite contained in the pearlite colonies which colonies also include cementite ($Fe_3C$).

Figure 3:
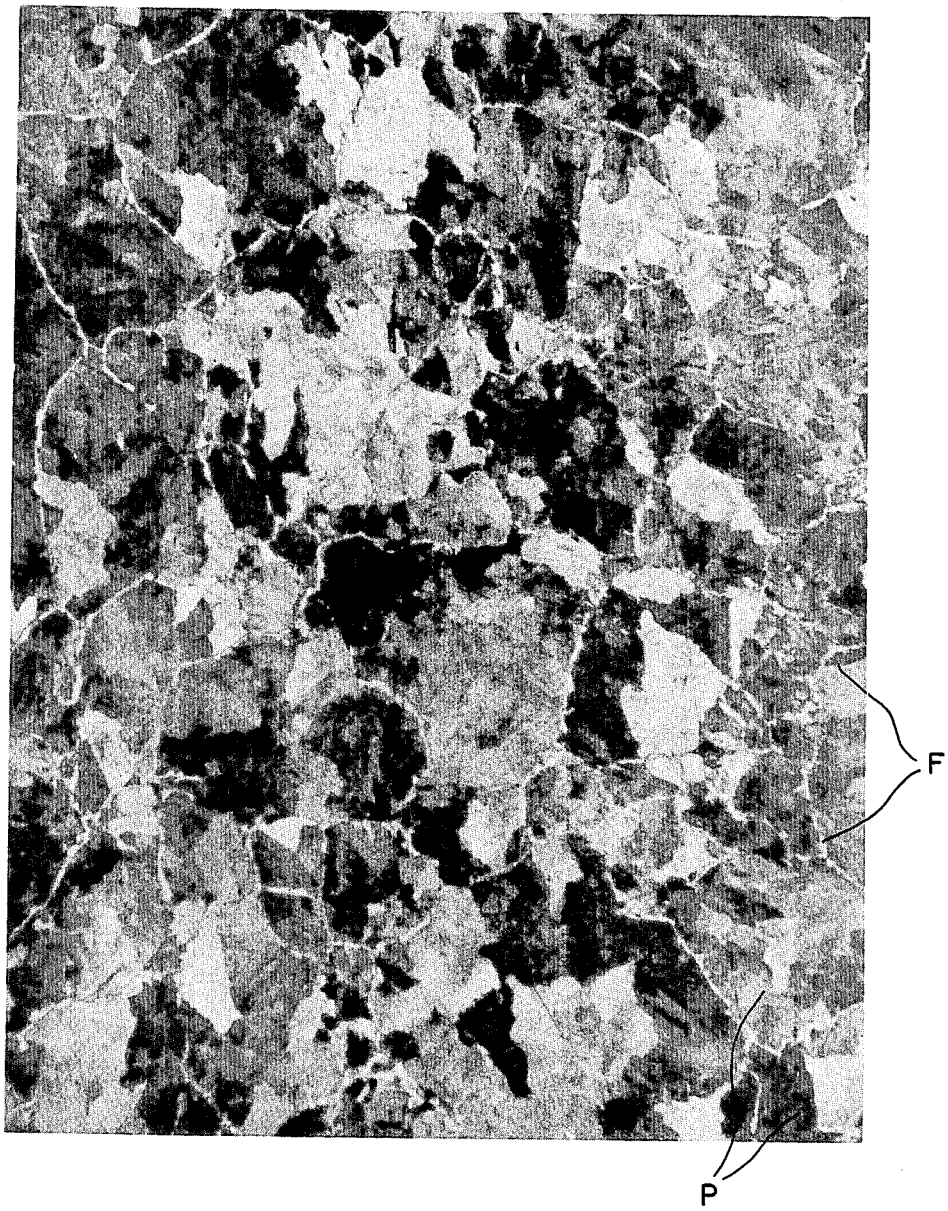
FIG. 3 is an enlarged drawing of a photomicrograph taken at 100x magnification of a preferred form of microstructure, showing pearlite colonies with a fine proeutectoid ferrite matrix.

In the present invention the multigrip pins 12 are processed such as to provide a microstructure having the desired combination of coarse grained pearlite colonies interspersed in a proeutectoid ferrite matrix such that the pins 12 are not totally unyielding and at the same time do not permit excessive deformation before fracture. FIG. 3 is a photomicrograph depicting the latter desired structure. Thus in FIG. 3 the coarse grained pearlite colonies are designated by the letter P and the thin, white lined boundaries F are the proeutectoid ferrite matrices. The particular photomicrograph of FIG. 3 is of a longitudinal section of the inner portion 23 (having combination grooves 22) of the pin 12 with the section taken at one half of the pin root radius (half way between the root surfaces and the axis of the pin 12). The specimen is AISI 1541 steel having a hardness of Rc26 and a grain size of ASTM 4. A 3% nital etch was utilized and the original photograph was taken at 100x magnification with the drawing of FIG. 4 enlarged to 1.75x.

It should be noted that in one form of the invention the multigrip fastener is desired to at least have the final installed mechanical characteristics of an SAE J429 Grade 2 coarse thread bolt or ASTM A307 Grade A bolt.

Thus it is desired that the microstructure of the finished pin 12 is comprised predominantly of coarse grained pearlite colonies in a fine matrix of proeutectoid ferrite. In order to reasonably arrive at such a structure it is advantageous to start with a billet with a minimum amount of segregation. In order to have a starting workpiece with a generally uniform or homogeneous microstructure, the steel is preferably strand (continuous) cast utilizing conventional coarse grain mill practices in casting and subsequent hot rolling procedures. Under such procedures the formation of a fine grained microstructure in the finished rod is inhibited; thus, for example, the steel is silicon killed (for deoxidization); if the steel were deoxidized by being aluminum killed the residual aluminum would promote fine grain size.

Figure 4:
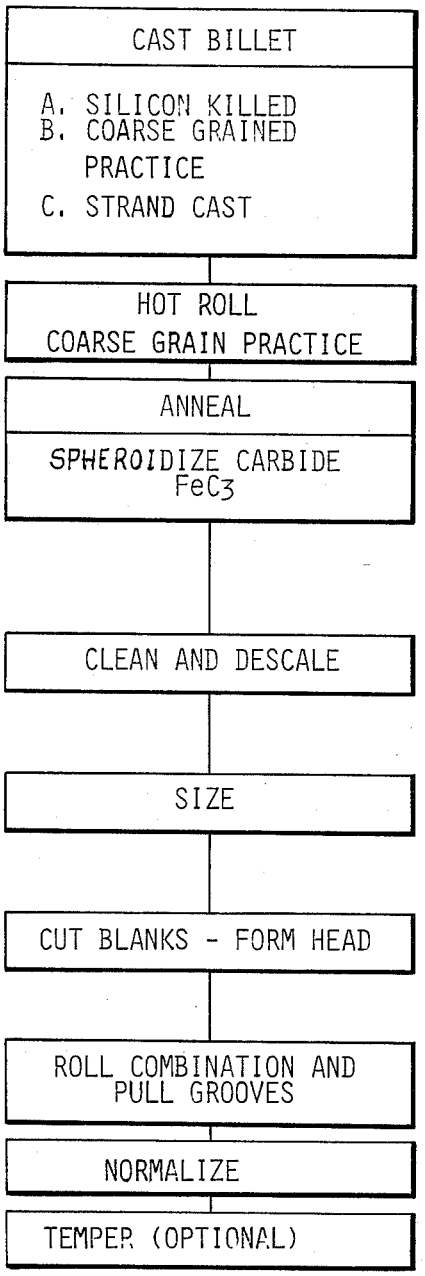
FIG. 4 is a flow or block diagram depicting steps in the process of the present invention as applied to the multigrip pin.

The various steps of the process of manufacturing the multigrip pin 12 are shown in the flow diagram of FIG. 4. Before following the process, however, the make up of the material of the billet should be considered.

For the pins noted, medium carbon steels are utilized such as SAE or AISI 1541, or SAE or AISI 1340. Thus the material is preferably a medium carbon steel which is comprised of the following elements (by weight):

Carbon: from about 0.30% to about 0.60%
Manganese: from about 0.9% to about 2.0%
Phosphorous: about 0.050% (max)
Sulfur: about 0.050% (max)
Silicon: from about 0.10% to about 0.60%
Iron: remainder.

The carbon when combined with iron provides the hard constituent of the material. The manganese aids in increasing hardenability. The range of manganese reflects the desired amount for the different diameters of pins 12 from around 3/16" to around ¾". Generally for larger pin diameters the amount of manganese will be higher in the noted range while with smaller pin diameters it will be lower. Other conventional alloying elements could be used in place of or in combination with manganese such as molybdenum, chromium, and vanadium. Since phosphorous and sulfur are undesirable impurities the quantities noted generally reflect an upper limit. Silicon is present from the silicon kill in the formation of the billet and does not substantially restrict grain growth. Silicon is used to deoxidize the steel in its formation and itself does not cause grain growth; it does not inhibit grain growth, however, in the manner of other de-oxidizing agents such as aluminum, etc., which if permitted to remain in solution would tend to provide a fine grained microstructure which is undesirable.

Looking now to the flow diagram of FIG. 4 at the Cast Billet stage, a billet is formed preferably by strand or continuous casting utilizing conventional coarse grain mill practices, e.g. steel which has been silicon killed. Preferably the billet is generally homogenous in its microstructure; banding segregation, i.e. longitudinal bands of pearlite, manganese, silicon, etc. have been minimized.

Next the billet is hot rolled into bars or rods of smaller diameter. At this step, the microstructure can be optimized for use in the finished pin. The amount of proeutectoid ferrite can be reduced, if desired, by creating a coarse grain structure. Thus the microstructure is comprised predominantly of coarse grained pearlite colonies; with an apparent austenitic grain size of from about ASTM 1 to about ASTM 5, interspersed in a matrix of proeutectoid ferrite.

Decarburization of the billet and rod can be minimized which also enhances the mechanical properties of the finished pin. If the rod is to be annealed to facilitate subsequent heading and rolling operations, the proeutectoid ferrite matrix need not be as closely controlled nor decarburization of the rod surface or substrate. In any event, the desired characteristics can be achieved in subsequent heat treatment of the headed and rolled pin. It is advantageous, however, if these characteristics are at least partially formed in the rod because they then can be more easily fully attained in heat treatment.

In some cases it is preferred that the rod be annealed to facilitate subsequent forming steps i.e. heading, etc. Thus the rod is processed at the Anneal stage where it is heated to a temperature of from about 1200° F. to about 1400° F. for the time necessary to spheroidize anneal the steel. In one application the rod was held at the anneal temperature for approximately twenty eight (28) hours. In some applications it may be desirable to time cycle the temperature e.g. from about 1380° F. to about 1280° F., etc. The annealed rod is furnace cooled and will be at a desired hardness of from about Rockwell Rb85 to about Rb95 to facilitate heading and rolling.

At the Clean and Descale step the oxide coating is removed while at the Size step the descaled rod is sized, as by drawing, to the desired diameter.

Next blanks of desired length are cut from the sized rod and the blanks are headed to form the enlarged pin head 14. The headed blanks are then rolled to form the combination locking and breakneck grooves 22 and the pull grooves 20. The pin 12 now has been formed substantially to its final geometric shape. The pin 12, however, will not have the desired microstructure because of the spheroidize anneal step and the decarburization at the surface and adjacent substrate in the formed rod. If the pin 12 were now simply normalized to produce the desired microstructure and hardness without carbon restoration at the surface, the surface (and substrate) of the pin 12 would contain excess ferrite and would be deficient in the harder pearlite. Thus, hardness at the surface would be less than that towards the center. The microstructure at the surface and adjacent substrate of the pin 12 is significant for fracture control. This is because, for dependable fractures, the surface of the locking groove must fully transmit the force exerted upon it by the swaging action of the collar. If it is soft, it will partially crush and fail to transmit the full load. Thus excess ferrite is undesirable at and near the surface of pin 12.

In order to bring the pin 12 to the desired hardness and also to provide the desired microstructure at and near the surface, the pin 12 is hardened in a Normalizing step at which time carbon restoration also takes place.

Thus after conventional degreasing the pins 12 are Normalized in a carbon restoring atmosphere at from about 1600° F. to about 1800° F. In one application the pins 12 were held at the austenitizing temperature for about one and one half hours. The pins 12 are held at that temperature long enough to austenitize and carbon restore the steel. In order to restore the carbon lost at the surface and adjacent substrate, carbon restoration is provided by maintaining a furnace atmosphere dew point of from about 25° F. to about 35° F. to provide a carbon potential at and near the surface of from about 0.40% to about 0.60%. In one system a dew point of about 26° F. was used in the normalizing furnace. Thus in this way the area at and near the surface of pin 12 will have a hardness at least equal to that of the core. It is believed that this promotes more uniform properties between the core and the surface and thereby assists in fracture control. Thus while the microstructure at the pin surface and adjacent substrate is significant it is preferable that the final microstructure should be complementary between the surface and the core, i.e. both hardness and microstructure. Note that at this point longitudinal banding segregation has been effectively minimized.

Next the pins 12 are cooled at a temperature typically of from about 100° F. to about 400° F. in air or in an inert gas atmosphere such as nitrogen. The cooling temperature and rate will be varied depending upon the hardenability of the material. After the pins 12 have cooled sustantially (to less than about 1000° F.) they may be further quenched in liquid. The final desired hardness for the type of pin 12 noted typically will be within the range of from about Rockwell 19Rc to about 29Rc.

The above Normalizing step can be modified depending upon the material, i.e., the amount of carbon restoration desired and the final desired hardness.

An optional tempering operation following normalizing may be used to control the final hardness of the finished pin. Typical temperatures used vary from about 400° F. to about 1000° F. Hardness of the tempered pins will remain in the range of about Rockwell 19Rc to about 29Rc.

While it will be apparent that the preferred embodiments of the invention disclosed are well calculated to fulfill the objects above stated, it will be appreciated that the invention is susceptible to modification, variation and change without departing from the proper scope or fair meaning of the invention.

What is claimed is:

1. In a swage-type fastener including a pin and a collar adapted to be swaged onto said pin, the method of making said pin wherein said pin includes a plurality of combination locking and breakneck grooves and with said collar adapted to be swaged into said grooves with one of said grooves acting as a breakneck whereby excess length of said pin is severed at that one of said grooves generally at the end of said collar and in response to a relative axial force applied between said pin and said collar, said method comprising:

(a) forming a steel billet, (b) hot rolling said billet into a rod, (c) sizing said rod to the desired diameter, (d) cutting blanks of desired length from said sized rod and forming an enlarged pin head on said cut blanks, (e) rolling said cut blanks to form a pin having combination locking and breakneck grooves thereon, (f) normalizing said pin at a preselected temperature in a carbon restoring atmosphere to austenitize and carbon restore the steel, and (g) cooling said pin from its austenitized state to form a generally homogeneous microstructure comprised predominantly of coarse grained pearlite colonies in a fine matrix of proeutectoid ferrite, said pearlite colonies having an apparent austenetic grain size of from about ASTM 1 to about ASTM 5, whereby fracture at said one of said grooves is facilitated.

2. The method of claim 1 wherein said billet is formed of medium carbon steel comprised of from about 0.30 to about 0.60% by weight carbon, from about 0.9 to about 2.0% by weight manganese, up to about 0.050% by weight phosphorous, up to about 0.050% by weight sulfur, from about 0.10 to about 0.60% by weight silicon, and the remainder iron.

3. The method of claim 1 wherein said billet is formed by strand casting.

4. The method of claim 1 wherein said billet is silicon killed.

5. The method of claim 1 wherein said rod after hot rolling is annealed at a temperature of from about 1200° F. to about 1400° F.

6. The method of claim 1 wherein said pin after having grooves rolled thereon is normalized at a temperature of from about 1600° F. to about 1800° F.

7. The method of claim 1 wherein said carbon restoring atmosphere comprises a normalizing furnace atmosphere dew point of from about 25° F. to about 35° F.

8. The method of claim 7 wherein said carbon restoring atmosphere provides a carbon potential at or near the surface of from about 0.40% to about 0.60%.

9. The method of claim 1 wherein said normalized pin is cooled from its austenitized state at a temperature of from about 100° F. to about 400° F.

10. The method of claim 1 wherein said cooling is conducted in a gas atmosphere.

11. The method of claim 1 including the step of annealing said rod after said hot rolling step.

12. In a swage-type fastener including a pin having a plurality of combination locking and breakneck grooves and collar adapted to be swaged into said grooves with one of said grooves acting as a breakneck whereby excess length of said pin is severed at that one of said grooves generally at the end of said collar and in response to a relative axial force applied between said pin and said collar, said pin having a generally homogenous microstructure comprised predominantly of coarse grained pearlite colonies in a fine matrix of proeutectoid ferrite, said pearlite colonies having an apparent austenitic grain size of from about ASTM 1 to about ASTM 5, whereby fracture at said one of said grooves is facilitated, said pin made by the process comprising:

(a) forming a steel billet, (b) hot rolling said billet into a rod, (c) sizing said rod to the desired diameter, (d) cutting blanks of desired length from said sized rod and forming an enlarged pin head on said cut blanks, (e) rolling said cut blanks to form said pin having combination locking and breakneck grooves thereon, (f) heating said pin to an austenitizing temperature in a carbon restoring atmosphere, and (g) cooling said pin from the austenitizing temperature to form said generally homogenous microstructure.

13. The product of claim 12 wherein said carbon restoring atmosphere of step (f) of the process of making said pin comprises a normalizing furnace atmosphere dew point of from about 25° F. to about 35° F.

14. The product of claim 13 wherein said carbon restoring atmosphere of step (f) of the process of making said pin provides a carbon potential at or near the surface of from about 0.40% to about 0.60%.

15. The method of claim 1 with said normalizing and cooling steps controlled to provide said pin to have a hardness at and near its surface at least equal to the hardness at its core.

16. The product of claim 12 wherein said heating and cooling steps of steps (f) and (g) of the process of making said pin are controlled to provide said pin to have a hardness at and near its surface at least equal to the hardness at its core.

* * * * *